US010023931B2

(12) United States Patent
Haji et al.

(10) Patent No.: US 10,023,931 B2
(45) **Date of Patent: *Jul. 17, 2018**

(54) METHOD OF PRODUCTION OF HOT DIP GALVANNEALED STEEL SHEET WITH EXCELLENT WORKABILITY, POWDERABILITY, AND SLIDABILITY

(75) Inventors: Junji Haji, Himeji (JP); Kaoru Kawasaki, Himeji (JP); Kiyokazu Ishizuka, Himeji (JP); Teruaki Yamada, Himeji (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/225,170

(22) PCT Filed: Mar. 28, 2007

(86) PCT No.: PCT/JP2007/057499
§ 371 (c)(1),
(2), (4) Date: Sep. 16, 2008

(87) PCT Pub. No.: WO2007/119665
PCT Pub. Date: Oct. 25, 2007

(65) Prior Publication Data

US 2009/0151820 A1 Jun. 18, 2009

(30) Foreign Application Priority Data

Apr. 7, 2006 (JP) ..... 2006-106528

(51) Int. Cl.

| | |
|---|---|
| ***C23C 2/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C23C 2/04*** | (2006.01) |
| ***C23C 2/06*** | (2006.01) |
| ***C23C 2/26*** | (2006.01) |
| ***C23C 2/28*** | (2006.01) |

(52) U.S. Cl.
CPC ..... *C21D 9/46* (2013.01); *C22C 38/001* (2013.01); *C22C 38/02* (2013.01); *C22C 38/04* (2013.01); *C22C 38/06* (2013.01); *C23C 2/02* (2013.01); *C23C 2/04* (2013.01); *C23C 2/06* (2013.01); *C23C 2/26* (2013.01); *C23C 2/28* (2013.01)

(58) Field of Classification Search
CPC ..... C23C 2/02; C23C 38/06; C21D 9/45
USPC ..... 148/533; 428/659
See application file for complete search history.

(56) References Cited

U.S. PATENT DOCUMENTS

| | | | | |
|---|---|---|---|---|
| 4,408,561 | A * | 10/1983 | Yokoyama | C23C 2/40 118/101 |
| 5,059,455 | A * | 10/1991 | Hasselbach | C23C 2/02 205/141 |
| 2002/0197508 | A1 | 12/2002 | Yoshinaga et al. | |
| 2003/0129444 | A1 | 7/2003 | Matsuoka et al. | |
| 2005/0247383 | A1* | 11/2005 | Utsumi et al. | 148/533 |
| 2013/0273389 | A1* | 10/2013 | Kaneko | C09D 5/084 428/626 |

FOREIGN PATENT DOCUMENTS

| | | | | |
|---|---|---|---|---|
| JP | 61067793 | A * | 4/1986 | C25D 5/26 |
| JP | 3-24255 | A | 2/1991 | |
| JP | 4-147953 | A | 5/1992 | |
| JP | 4-333552 | A | 11/1992 | |
| JP | 4-346647 | A | 12/1992 | |
| JP | 06-128758 | A | 5/1994 | |
| JP | 07-003417 | A | 1/1995 | |
| JP | 07-009055 | B2 | 2/1995 | |
| JP | 07-034213 | A | 2/1995 | |
| JP | 7-278770 | A | 10/1995 | |
| JP | 2783452 | B2 | 5/1998 | |
| JP | 2001-140038 | A | 5/2001 | |
| JP | 2001-303228 | A | 10/2001 | |
| JP | 2005-54199 | A | 3/2005 | |
| JP | 2005-200694 | | 7/2005 | |
| JP | 2005-256089 | A | 9/2005 | |

(Continued)

OTHER PUBLICATIONS

Machine translation of JP 2001303228.*

(Continued)

*Primary Examiner* — Matthew E Hoban
(74) *Attorney, Agent, or Firm* — Birch, Stewart, Kolasch & Birch, LLP

(57) ABSTRACT

The present invention provides a method of production of hot dip galvannealed steel sheet with excellent workability compared with the Sendzimir method or non-oxidizing furnace method and further with excellent powdering or slidability, that is, a method of production of hot dip galvannealed steel sheet with excellent workability, powdering, and slidability characterized by processing a slab containing, by mass %, C: 0.01 to 0.12%, Mn: 0.05 to 0.6%, Si: 0.002 to 0.1%, P: 0.05% or less, S: 0.03% or less, sol. Al: 0.005 to 0.1%, and N: 0.01% or less and having a balance of Fe and unavoidable impurities by hot rolling, pickling, cold rolling, then annealing at 650 to 900° C., cooling to 250 to 450° C., holding at said temperature range for 120 seconds or more, then cooling to room temperature, pickling, preplating Ni or Ni—Fe without intermediate temper rolling, heating by 5° C./sec or more down to 430 to 500° C., galvanizing in a galvanization bath, wiping, then heating by a rate of temperature rise of 20° C./sec or more up to 460 to 550° C., not providing any soaking time or holding for soaking for less than 5 seconds, then cooling by 3° C./sec or more, and final temper rolling by a 0.4 to 2% elongation rate.

3 Claims, 1 Drawing Sheet

(56) References Cited

FOREIGN PATENT DOCUMENTS

| | | | |
|---|---|---|---|
| KR | 10-2003-0091942 | A | 12/2003 |
| KR | 10-0811035 | B1 | 3/2008 |
| WO | WO 02/42512 | A1 | 5/2002 |
| WO | WO-2005/068676 | A1 | 7/2005 |

OTHER PUBLICATIONS

Machine translation of JP 2005256089.*
Office Communication issued on Feb. 10, 2010 by the Chinese Patent Office in corresponding Chinese Application No. 2007800119574.
Office Action dated Feb. 24, 2009 for Korean Application No. 10-2007-7024006.

* cited by examiner

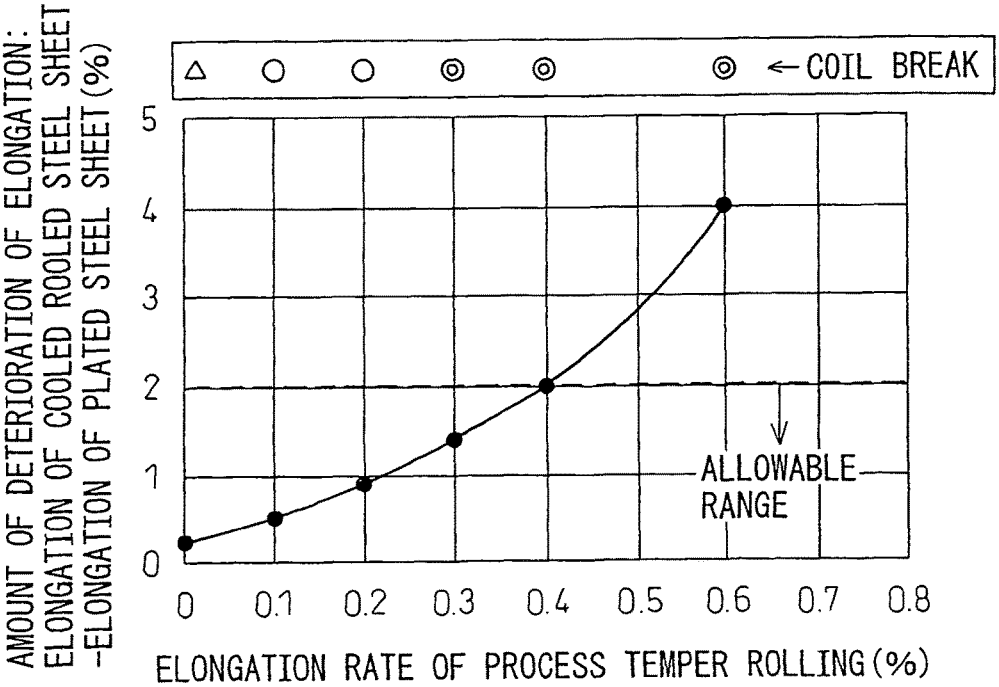
AMOUNT OF DETERIORATION OF ELONGATION:
ELONGATION OF COOLED ROOLED STEEL SHEET
-ELONGATION OF PLATED STEEL SHEET (%)
△ ○ ○ ◎ ◎ ◎ ← COIL BREAK
5
4
3
2
1
0
ALLOWABLE RANGE
0 0.1 0.2 0.3 0.4 0.5 0.6 0.7 0.8
ELONGATION RATE OF PROCESS TEMPER ROLLING (%)

METHOD OF PRODUCTION OF HOT DIP GALVANNEALED STEEL SHEET WITH EXCELLENT WORKABILITY, POWDERABILITY, AND SLIDABILITY

TECHNICAL FIELD

The present invention relates to a method of production of hot dip galvannealed steel sheet with excellent workability, powdering, and slidability.

BACKGROUND ART

In recent years, hot dip galvannealed steel sheet has been used in large quantities for automobiles etc. This hot dip galvannealed steel sheet is usually produced by the Sendzimir method or the non-oxidizing furnace method, but after cold rolling has to be heated to an 800° C. or so high temperature and cannot be overaged like with a continuous annealing line after plating. For that reason, in the case of soft low carbon Al-killed steel or B-containing low carbon Al-killed steel, solute C remains in a large amount. Compared with cold rolled steel sheet produced by the cold rolling-continuous annealing process, the yield strength is high, yield point elongation easily occurs, the elongation is low, and workability is otherwise degraded unavoidably. Specifically, in terms of elongation, 4% or more deterioration occurs.

On the other hand, Japanese Patent No. 2783452 discloses a method of production of hot dip galvannealed steel sheet preplating the sheet with Ni, then rapidly heating it to 430 to 500° C., galvanizing it, then alloying it. In the case of this method, even at a high temperature, it is only necessary to raise the temperature to the 550° C. or so at the time of alloying. As the raw sheet, it is possible to use cold rolled steel sheet produced by the cold rolling-continuous annealing process. However, in cold rolled steel sheet, to prevent the occurrence of stripe patterns called coil break and correct the shape, the usual practice is to perform temper rolling at a 0.6 to 1.5% or so elongation rate. When passing cold rolled steel sheet of low carbon Al-killed steel subjected to that extent of temper rolling through a galvanization process using the above Ni preplating method, the solute C adheres to the movable dislocations at the time of a temperature rise and the workability deteriorates in a "strain aging phenomenon".

DISCLOSURE OF THE INVENTION

The present invention has as its object the provision of a method of production of plated steel sheet able to give hot dip galvannealed steel sheet with excellent workability compared with the Sendzimir method or non-oxidizing furnace method and further with excellent powdering or slidability. The inventors intensively studied the method of production of hot dip galvannealed steel sheet and as a result discovered that by not performing temper rolling at all between the cold rolling-continuous annealing process and a galvanization processing using the Ni preplating method or applying it by a 0.4% or less elongation rate, excellent hot dip galvannealed steel sheet with little deterioration in workability can be produced and further that the powdering and slidability can be secured by keeping the temperature pattern at the time of alloying within certain conditions and thereby completed the present invention. The gist of the present invention is as follows:

(1) A method of production of hot dip galvannealed steel sheet with excellent workability, powdering, and slidability characterized by processing a slab containing, by mass %, C: 0.01 to 0.12%, Mn: 0.05 to 0.6%, Si: 0.002 to 0.1%, P: 0.05% or less, S: 0.03% or less, sol. Al: 0.005 to 0.1%, and N: 0.01% or less and having a balance of Fe and unavoidable impurities by hot rolling, pickling, cold rolling, then annealing at 650 to 900° C., cooling to 250 to 450° C., holding at said temperature range for 120 seconds or more, then cooling to room temperature, pickling, preplating Ni or Ni—Fe without process temper rolling, heating by 5° C./sec or more down to 430 to 500° C., galvanizing in a galvanization bath, wiping, then heating by a rate of temperature rise of 20° C./sec or more up to 460 to 550° C., not providing any soaking time or holding for soaking for less than 5 seconds, then cooling by 3° C./sec or more, and final temper rolling by a 0.4 to 2% elongation rate.

(2) A method of production of hot dip galvannealed steel sheet with excellent workability, powdering, and slidability as set forth in (1) characterized in that the slab contains, by mass %, B: 0.005% or less.

(3) A method of production of hot dip galvannealed steel sheet with excellent workability, powdering, and slidability as set forth in (1) or (2) characterized by temper rolling by a 0.4% or less elongation rate before that preplating.

BRIEF DESCRIPTION OF THE DRAWINGS

FIG. 1 is a graph measuring the amount of deterioration of the elongation (elongation of cold rolled steel sheet—elongation of plated steel sheet) for the various plated steel sheets produced in the scope of the present invention minus the elongation rate of the intermediate temper rolling and the cold rolled steel sheet up to the intermediate stage and plotting the average values with respect to the elongation rates of the intermediate temper rolling. Further, the state of occurrence of coil break at the plated steel sheet at the elongation rate of the intermediate temper rolling is shown as "fair" (light coil break), "good" (very light coil break), and "very good" (no coil break).

BEST MODE FOR CARRYING OUT THE INVENTION

First, the reasons for limiting the ingredients and range of ingredients of the steel sheet covered by present invention will be explained. Note that below the "mass %" in the composition will be indicated as simply "%".

C is a hardening element and is advantageous for workability the smaller the amount, but if less than 0.01%, the aging deterioration becomes large, so this is not preferred. Further, if the amount of C becomes large, the steel becomes too hard, while if over 0.12%, the workability deteriorates. Therefore, the amount of C was made 0.01 to 0.12%.

Mn is an element required for imparting toughness. 0.05% or more in amount is necessary. Further, if the amount of Mn becomes greater, the workability deteriorates, so the upper limit was made 0.6%.

Si is added as a deoxidizing element of steel, but if becoming too great, the workability or the chemical convertability is degraded, so the range was made 0.002 to 0.1%.

P is unavoidably contained as an impurity and has a detrimental effect on the elongation, so the upper limit was made 0.05%.

S, if too great, becomes a cause of hot embrittlement and, further, degrades the workability, so (25 the upper limit was made 0.03%.

Al is added as a deoxidizing agent of steel and is contained in the steel, but Al causes the solute N in the steel to precipitate as AlN and is an important element for reducing the solute N. Therefore, in terms of sol. Al of 0.005% or more is necessary. On the other hand, the elongation is improved as the amount of Al becomes greater, but if over 0.1%, the workability is degraded, so Al was made 0.005 to 0.1%.

N is contained as an unavoidable impurity, but if remaining as solute N, becomes a cause of coil break. It can be made to precipitate by adding Al or B, but if the amount of N is great, it leads to deterioration of the workability, so the upper limit was made 0.01%.

B causes the N in the steel to precipitate as BN, so is an important element for reducing the solute N. However, if the amount of B increases, the increase in the solute B causes deterioration of the material, so B may be added in accordance with need in a range of 0.005% or less.

Next, a method of production of hot dip galvannealed steel sheet of the present invention will be explained in detail. Molten steel is produced by the usual blast furnace method. Scrap may also be used in a large amount by the electrical furnace method. The slab may also be produced by the usual continuous casting process or may be produced by thin slab casting. The slab may be cooled once, then heated in a heating furnace before hot rolling or may be loaded into a heating furnace in the high temperature state in the middle of cooling, that is, so-called HCR and DR are both possible.

The hot rolling is performed under the usual production conditions of cooled rolled steel sheet of the above ingredients. A coil box coiling up and holding a rough bar after rough rolling may also be used. Further, joining and rolling rough bars before uncoiling the coiled up rough bars, that is, so-called continuous hot rolling, is also possible.

The pickling and the cold rolling are also performed under the ordinary production conditions in cold rolled steel sheet of the above ingredients. In the continuous annealing process after cold rolling, first the steel is recrystallized and annealed at 650 to 900° C. If less than 650° C., sufficient recrystallization does not occur and leads to deterioration of the workability. Further, if over 900° C., the surface conditions deteriorate due to the abnormal grain growth. The holding time at that time is preferably about 30 to 200 seconds.

Next, the steel is cooled down to 250 to 450° C. and held at that temperature range for 120 seconds or more for averaging so as to reduce the solute C. If outside that temperature range and the holding time is short, cementite is hard to precipitate and the solute C is insufficiently reduced. Further, the cooling pattern from the recrystallization annealing is not particularly limited, but a cooling rate at 600° C. or less of 50° C./sec or more is preferable. The temperature pattern of the averaging is also not particularly limited, but holding near the cooling end temperature is possible and gradually cooling from that temperature is possible. Further, the pattern of cooling once down to 250° C. or so, then heating until 450° C. or so, then gradually cooling is preferable in terms of reduction of the solute C. Further, to remove the scale formed at the time of continuous annealing, it is necessary to perform the pickling again after continuous annealing.

The temper rolling after the continuous annealing is the most important point in the present invention. As shown in FIG. 1, if the elongation rate of the temper rolling is 0, that is, if the rolling is not performed at all, there is almost no deterioration of the elongation. This is because due to this, the subsequent aging deterioration is suppressed. However, in this case, light coil break occurs due to the bending by the rolls up to the rise in temperature in the galvanization process and remains even after plating. This is all right with applications where some coil break is not a problem, but becomes a problem in outer panels of automobiles and other materials where appearance is crucial. In that case, temper rolling by a 0.4% or less elongation rate is preferable. The higher the elongation rate, the worse the workability of the plated steel sheet, but the deterioration of elongation can be suppressed to 2% or so. Further, prevention of coil break can simultaneously be achieved. Accordingly, it is necessary to determine whether to perform temper rolling at this intermediate stage and the elongation rate in accordance with the application of the final product by the balance between the workability and surface conditions.

In the galvanization process, first, to secure the plating adhesion, Ni or Ni—Fe alloy is preplated. As the amount of plating, 0.2 to 2 g/m$^2$ or so is preferable. The method of preplating may be any of electroplating, dip plating, and spray plating. After that, for plating, the sheet is heated by 5° C./sec or more to 430 to 500° C. With a rate of temperature rise of less than 5° C./sec, the solute C easily moves and leads to a deterioration of the workability. Preferably, the temperature is raised by 30° C./sec or more to further suppress the deterioration. Further, if this heating temperature is less than 430° C., nonplating defects easily occur at the time of plating, while if over 500° C., the rust resistance of the worked parts deteriorates. Next, the sheet is galvanized in a galvanization bath, wiped, then heated by a rate of temperature rise of 20° C./sec or more to 460 to 550° C., then either not soaked or held for soaking for less than 5 seconds, then cooled by 3° C./sec or more. With a rate of temperature rise of less than 20° C./sec, the slidability deteriorates. With a heating temperature of less than 460° C., alloying insufficiently occurs, so the slidability deteriorates, while if over 550° C., the deterioration of the workability becomes greater. If the soaking holding time exceeds 5 seconds or the cooling rate becomes less than 3° C./sec, the alloying proceeds too much and the powdering becomes poorer.

After the galvanization process, final temper rolling is performed for the final shape correction and elimination of yield point elongation. In this temper rolling, if the elongation rate is less than 0.4%, the yield point elongation will not disappear, while if the elongation rate exceeds 2%, hardening occurs and the elongation sharply drops. Accordingly, the elongation rate was made 0.4 to 2%.

The processes after the above hot rolling, that is, the pickling, cold rolling, continuous annealing, temper rolling (process), preplating, galvanization (including alloying), and temper rolling (final), may be mutually independent processes or may be partially continuous processes. If considered from the production efficiency, making all of these continuous would be ideal.

EXAMPLES

Example 1

Continuously cast slabs of 250 mm thickness having the compositions of ingredients shown in Table 1 were reheated to 1200° C., then roughly rolled, finally rolled at 900° C.

ending at sheet thicknesses of 2.8 mm, then taken up into coils at 600° C. on an actual continuous hot rolling line. These hot rolled coils were continuously treated by pickling-cold rolling-continuous annealing-temper rolling on an actual line to obtain cold rolled steel sheets. These were cold rolled down to sheet thicknesses of 0.8 mm, annealed at 730° C. for 60 seconds, then cooled down to 650° C. by 2° C./sec and from 650° C. to 400° C. by 100° C. sec, held at 350 to 400° C. for 240 seconds, then cooled down to room temperature, then pickled and sampled without temper rolling. The samples were then treated in the laboratory. Either no temper rolling was performed or it was performed with a 1% or less elongation rate. After that, the steel sheets were preplated by Ni to 0.5 g/m$^2$ on one side, heated by 30° C./sec to 470° C., then galvanized in a galvanization bath, heated by 30° C./sec to 500° C., then cooled by 5° C./sec or more down to room temperature, and treated by final temper rolling by an 0.8% elongation rate. The materials of the steel sheets were examined by tensile tests using JIS No. 5 tensile test pieces. That results of the evaluation of the materials and coil break are shown in Table 2. Further, for comparison, the results of evaluation of the materials and coil break of intermediate stage cold rolled steel sheets as they are and hot dip galvannealed steel sheets of the same ingredients produced by the Sendzimir method are also shown in Table 2.

TABLE 1

(mass %)

| Steel type | C | Mn | Si | P | S | Sol. Al | N | B |
|---|---|---|---|---|---|---|---|---|
| A | 0.07 | 0.40 | 0.010 | 0.015 | 0.006 | 0.05 | 0.0050 | — |
| B | 0.04 | 0.15 | 0.005 | 0.012 | 0.004 | 0.03 | 0.0025 | 0.0025 |

As shown in Table 2, in the invention examples, the amount of deterioration of elongation with respect to cold rolled steel sheet as is (ΔEL) can be suppressed to within 2%. As opposed to this, in the comparative examples and Sendzimir method, the deterioration of elongation is large.

Example 2

Actually produced cold rolled steel sheets of the steel type A of Example 1 were temper rolled by a 0.4% elongation rate and were preplated by Ni to 0.5 g/m$^2$ on each side. The steel sheets were heated by 30° C./sec to 470° C., then held in a galvanization bath held at 450° C. (bath Al concentration 0.15%) for 3 seconds, then wiped to adjust the coating weight and alloyed by predetermined rates of temperature rise and temperatures right above the wiping. Without holding at those temperatures or after holding, the sheets were cooled by primary cooling by a cooling gas for 15 seconds, then cooled by air-water spraying down to room temperature. After that, they were final temper rolled at a 0.8% elongation rate.

The performance was evaluated not only by tensile tests similar to Example 1, but also for the platings in the following way. The results of the evaluation are shown in Table 3.

(a) Powdering: Samples coated with anti-rust oil were drawn under conditions of a drawing ratio of 2.0 to 40 mmφ cylinders, the tapes were peeled off from the side surfaces, and the states were evaluated by the degree of coil break. Samples with a coil break degree of 0 to less than 10% were evaluated as "very good", ones of 10 to less than 20% as "good", ones of 20 to less than 30% as "fair", and ones of 30% or more as "poor".

(b) Slidability: Samples coated with anti-rust oil were used for flat sheet continuous sliding tests. A compressive load of 500 kgf was used for five continuous sliding operations. The fifth coefficients of friction were used for evalu-

TABLE 2

| Steel type | Class | Elongation rate of process temper rolling (%) | YP (MPa) | TS (MPa) | EL (%) | ΔEL (%) | Evaluation of coil break |
|---|---|---|---|---|---|---|---|
| A | Cold rolled steel sheet as is | — | 270 | 376 | 41.5 | — | Very good |
| | Invention examples | 0 | 273 | 373 | 41.3 | 0.2 | Fair |
| | | 0.1 | 276 | 375 | 40.9 | 0.6 | Good |
| | | 0.4 | 284 | 372 | 39.7 | 1.8 | Very good |
| | Comparative example | 0.6 | 298 | 375 | 37.4 | 4.1 | Very good |
| | Sendzimir method | — | 293 | 371 | 37.9 | 3.6 | Very good |
| B | Cold rolled steel sheet as is | — | 201 | 335 | 45.6 | — | Very good |
| | Invention examples | 0 | 203 | 338 | 45.3 | 0.3 | Fair |
| | | 0.1 | 208 | 340 | 44.8 | 0.8 | Good |
| | | 0.4 | 213 | 333 | 43.6 | 2.0 | Very good |
| | Comparative example | 0.6 | 230 | 336 | 41.2 | 4.4 | Very good |
| | Sendzimir method | — | 227 | 339 | 41.5 | 4.1 | Very good |

Note 1:

ΔEL is amount of deterioration of elongation with respect to elongation of cold rolled steel sheet as is Note 2:

Coil break is evaluated as "fair" (light coil break), "good" (very light coil break"), and "very good" (no coil break)

ation. Samples with a coefficient of friction of less than 0.13 were evaluated as "very good", ones of 0.13 to less than 0.16 as "good", ones of 0.16 to less than 0.2 as "fair", and ones of 0.2 or more as "poor".

TABLE 3

| Type | Rate of temperature rise (° C./sec) | Peak temperature (° C.) | Holding (sec) | Primary cooling rate (° C./sec) | Evaluation of powdering | Evaluation of slidability | ΔEL (%) |
|---|---|---|---|---|---|---|---|
| Invention examples | 20 | 460 | 0 | 5 | Very good | Very good | 1.5 |
| | 30 | 500 | 0 | 5 | Very good | Very good | 1.7 |
| | 50 | 530 | 2 | 3 | Very good | Very good | 1.8 |
| | 80 | 540 | 0 | 10 | Very good | Very good | 1.6 |
| | 30 | 550 | 4 | 5 | Very good | Very good | 2.0 |
| | 30 | 480 | 0 | 5 | Very good | Very good | 1.8 |
| Comparative examples | 10 | 500 | 0 | 5 | Very good | Fair | 1.6 |
| | 30 | 440 | 0 | 8 | Very good | Fair | 1.3 |
| | 50 | 570 | 3 | 6 | Very good | Very good | 3.2 |
| | 20 | 520 | 10 | 5 | Good | Very good | 2.0 |
| | 40 | 540 | 1 | 2 | Fair | Very good | 1.9 |

Note 1:
ΔEL is amount of deterioration of elongation with respect to elongation of as-cold rolled steel sheet As shown in Table 3, in the invention examples, the powdering and slidability are extremely good and further the amount of deterioration of elongation with respect to as cold rolled steel sheet can be kept within 2%. As opposed to this, in the comparative examples, the powdering or slidability deteriorates or the amount of deterioration of the elongation becomes larger.

INDUSTRIAL APPLICABILITY

According to the present invention, it is possible to obtain hot dip galvannealed steel sheet excellent in workability compared with the Sendzimir method or non-oxidizing furnace method and further excellent in powdering and slidability and has great industrial merits.

The invention claimed is:

1. A method of production of a hot dip galvannealed steel sheet with excellent powdering, slidability, and reduction in coil break, the hot dip galvannealed steel sheet having an amount of deterioration of elongation with respect to a cold rolled steel sheet of 2% or less, characterized by processing a slab containing, by mass %, C: 0.01 to 0.12%,
Mn: 0.05 to 0.6%,
Si: 0.002 to 0.1%,
P: 0.05% or less,
S: 0.03% or less,
sol. Al: 0.005 to 0.1%,
N: 0.01% or less, and having a balance of Fe and unavoidable impurities, by sequentially hot rolling, pickling, cold rolling, then annealing at 650 to 900° C., cooling to 250 to 450° C. by a cooling rate at 600° C. or less of 50° C./sec or more, overaging at a temperature range of 350° C. to 400° C. for 120 seconds or more, then cooling to room temperature, pickling, and temper rolling by 0.1 to 0.4% elongation rate, preplating Ni or Ni—Fe, and furthermore heating by 5° C./sec or more up to a temperature between 430 and 500° C., galvanizing in a galvanization bath, wiping, then heating by a rate of temperature rise of 20° C./sec or more up to 460 to 550° C., not providing any soaking time or holding for soaking for 4 seconds or less, then cooling by 3° C./sec or more, and final temper rolling by a 0.4 to 2% elongation rate;

wherein the steps of overaging for 120 seconds or more and temper rolling by 0.1% to 0.4% elongation rate occur before the step of preplating Ni or Ni—Fe.

2. The method of production of a hot dip galvannealed steel sheet as set forth in claim 1, characterized in that the slab contains, by mass %, B: 0.005% or less.

3. A method of production of a hot dip galvannealed steel sheet for motor vehicles, household electronics and buildings, said method comprising processing a slab containing, by mass %, C: 0.01 to 0.12%,
Mn: 0.05 to 0.6%,
Si: 0.002 to 0.1%,
P: 0.05% or less,
S: 0.03% or less,
sol. Al: 0.005 to 0.1%,
N: 0.01% or less, and
a balance of Fe and unavoidable impurities;

said processing of the slab comprising the following steps, in this order:

(a) hot rolling;
(b) pickling;
(c) cold rolling;
(d) annealing at 650° C. to 900° C.;
(e) cooling down to a temperature range of 250° C. to 450° C. at a cooling rate at 600° C. or less of 50° C./sec or more;
(f) overaging at said temperature range for 120 seconds or more;
(g) cooling to room temperature;
(h) pickling;

(i) temper rolling, wherein the elongation rate of temper rolling is 0.4% or less;

(j) preplating Ni or Ni—Fe, wherein an amount of plating is 0.2 to 2 $g/m^2$;

(k) heating at a rate of 30° C./sec or more up to a temperature between 430° C. and 500° C.;

(l) galvanizing in a galvanization bath;

(m)wiping;

(n) heating up to 460° C. to 550° C. at a rate of temperature rise of 20° C./sec or more;

(o) cooling at a rate of 3° C/sec or more; and (p) final temper rolling, wherein the elongation rate of the final temper rolling is 0.4 to 2%, wherein, after the step of heating at a rate of 30° C./sec or more up to a temperature between 430° C. and 500° C., no soaking time is provided, or the slab is held for soaking for 4 seconds or less, after galvanizing in a galvanization bath.

* * * * *